US009232303B2

(12) United States Patent
Absher et al.

(10) Patent No.: US 9,232,303 B2
(45) Date of Patent: Jan. 5, 2016

(54) APPARATUS FOR ENHANCING SOUND FROM PORTABLE DEVICES

(71) Applicant: Cellco Partnership, Basking Ridge, NJ (US)

(72) Inventors: Adam Absher, Lebanon, TN (US); Jason Pregel, Nashville, TN (US)

(73) Assignee: Cellco Partnership, Basking Ridge, NJ (US)

( * ) Notice: Subject to any disclaimer, the term of this patent is extended or adjusted under 35 U.S.C. 154(b) by 124 days.

(21) Appl. No.: 14/047,694

(22) Filed: Oct. 7, 2013

(65) Prior Publication Data

US 2015/0098601 A1 Apr. 9, 2015

(51) Int. Cl.

| | |
|---|---|
| ***H04R 25/00*** | (2006.01) |
| ***H04R 1/34*** | (2006.01) |
| *H04R 5/02* | (2006.01) |

(52) U.S. Cl.

CPC *H04R 1/345* (2013.01); *H04R 5/02* (2013.01); *H04R 2499/11* (2013.01); *H04R 2499/15* (2013.01)

(58) Field of Classification Search

CPC ..... H04R 5/02; H04R 1/345; H04R 2499/15; H04R 1/24; H04R 7/045; H04R 7/06; H04R 17/00; H04R 1/00; H04R 1/021; H04R 1/025; H04R 1/026; H04R 1/028; H04R 1/26; H04R 1/2811; H04R 1/2834; H04R 1/30; H04R 1/34; H04R 2201/021

USPC ..... 381/160, 152; 361/679.23, 679.41, 361/679.27; 181/155

See application file for complete search history.

(56) References Cited

U.S. PATENT DOCUMENTS

| | | | | |
|---|---|---|---|---|
| 6,324,052 | B1 * | 11/2001 | Azima et al. | 361/679.23 |
| 7,184,562 | B2 * | 2/2007 | Seki et al. | 381/160 |
| 2009/0171670 | A1 * | 7/2009 | Bailey et al. | 704/278 |
| 2010/0206923 | A1 * | 8/2010 | McNamara et al. | 224/191 |
| 2013/0322660 | A1 * | 12/2013 | Weiss | 381/160 |
| 2014/0133689 | A1 * | 5/2014 | Yu | 381/390 |

* cited by examiner

*Primary Examiner* — Davetta W Goins
*Assistant Examiner* — Phylesha Dabney

(57) ABSTRACT

An apparatus is disclosed for enhancing the sound level of portable devices by providing a sound reflector between the portable device and a case. The sound reflector includes a shield which functions to redirect output from rear facing speakers toward the front. The sound reflector can be extended for redirecting sound or retracted when not in use. A case incorporating a retractable sound reflector is also disclosed.

14 Claims, 13 Drawing Sheets

APPARATUS FOR ENHANCING SOUND FROM PORTABLE DEVICES

BACKGROUND INFORMATION

Portable devices such as mobile phones, tablets, etc. have gained significant popularity in recent years. These devices are used for various functions in addition to conventional voice-based communication. For example, various service providers offer premium features which allow users to watch videos, movies, etc. on the portable devices. There are also various websites which allow users to upload and watch video content from other users.

Portable devices typically include one or more speakers that allow users hear sound without the use of accessories such as headphones. Such speakers are generally placed at different locations on the rear surface of the portable device. For example, a single speaker may be centrally located along an edge of the rear surface, while dual speakers may be located in an opposing manner on the rear surface to simulate stereo sound. Due to the location of these speakers, the amount of sound which reaches the user is reduced based on the distance to a solid reflecting surface. Users often compensate for this reduction by placing a hand or object behind the speaker in order to reflect sound in their direction. This can be a cause of frustration and/or accidents because the portable device is not held in a secure manner.

Based on the foregoing, there is a need to provide a cost effective and simple manner to improve the sound from portable devices.

BRIEF DESCRIPTION OF THE DRAWINGS

Various exemplary embodiments are illustrated by way of example, and not by way of limitation, in the figures of the accompanying drawings in which like reference numerals refer to similar elements and in which.

DESCRIPTION OF THE PREFERRED EMBODIMENT

An apparatus is described for improving the sound level from portable devices. In the following description, for the purposes of explanation, numerous specific details are set forth in order to provide a thorough understanding of the disclosed embodiments. It is apparent, however, to one skilled in the art that various embodiments may be practiced without these specific details or with an equivalent arrangement. In other instances, well-known structures and devices are shown in block diagram form in order to avoid unnecessarily obscuring the various embodiments.

Figure 1A:
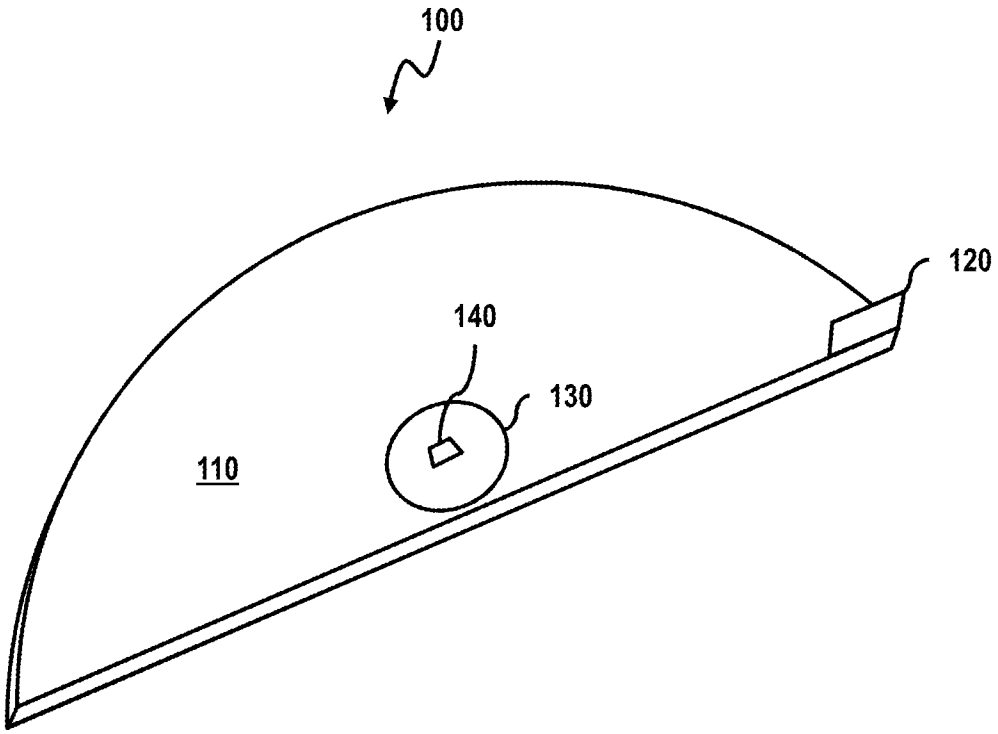
FIG. 1A is a perspective view of a sound reflector, according to one embodiment.
Figure 1B:
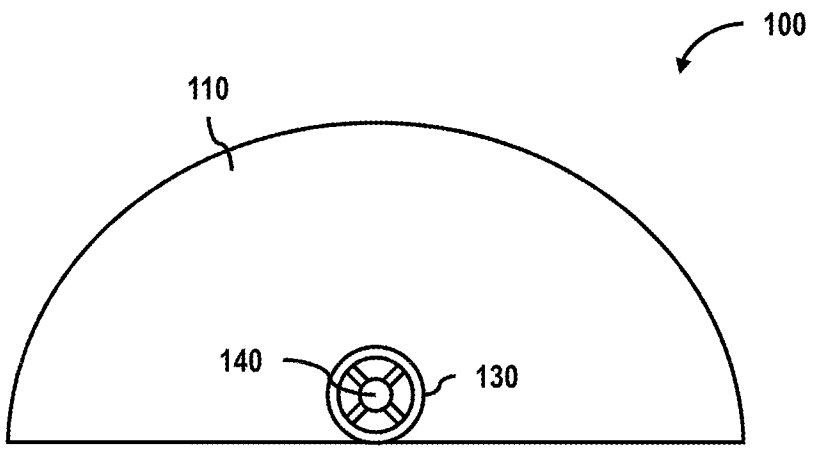
FIG. 1B is a top elevation view of the sound reflector shown in FIG. 1A.
Figure 1C:
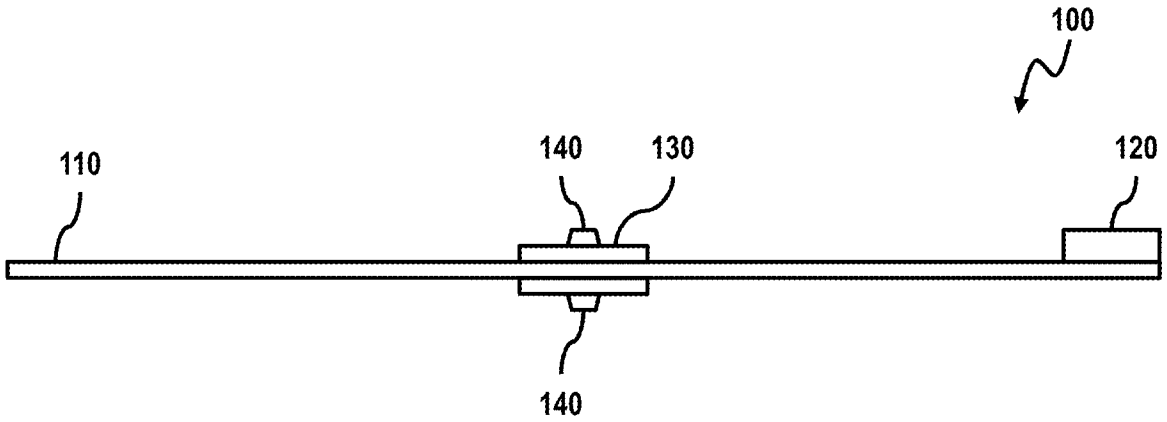
FIG. 1C is a front elevation view of the sound reflector shown in FIG. 1A.

FIGS. 1A-1C illustrate a sound reflector 100 in accordance with at least one embodiment. The sound reflector 100 includes a shield 110, which is illustrated as having a semicircular configuration, and a connector 130 that is located at approximately the midpoint of the straight edge of the shield 110. It should be noted, that the shield 110 can be configured to have various configurations, depending on the particular application. For example, the shield 110 can be configured as a rectangle or circle. Furthermore, the shield 110 can have a wedge shape having and angular displacement that is less than 180° (such as a semicircle) or greater than 180°. The sound reflector 100 also includes an engaging tab 120 which extends from an edge thereof. The engaging tab 120 extends in a generally flexible manner which allows it to occupy various displacement angles relative to the shield 110. For example, the engaging tab 120 can be moved (or bent) from a position that is substantially parallel to the surface of the shield 110 to position that is substantially perpendicular. The engaging tab 120 thus allows an operator to manipulate the sound reflector 100 when attempting to improve the sound quality of a portable device. As further illustrated, for example in FIG. 1C, the connector 130 can include one or more protrusions 140 which extend from an upper and/or lower surface thereof. As will be discussed in greater detail below, the protrusions 140 form a point of contact to allow movement and/or rotation of the sound reflector 100.

Figure 2A:
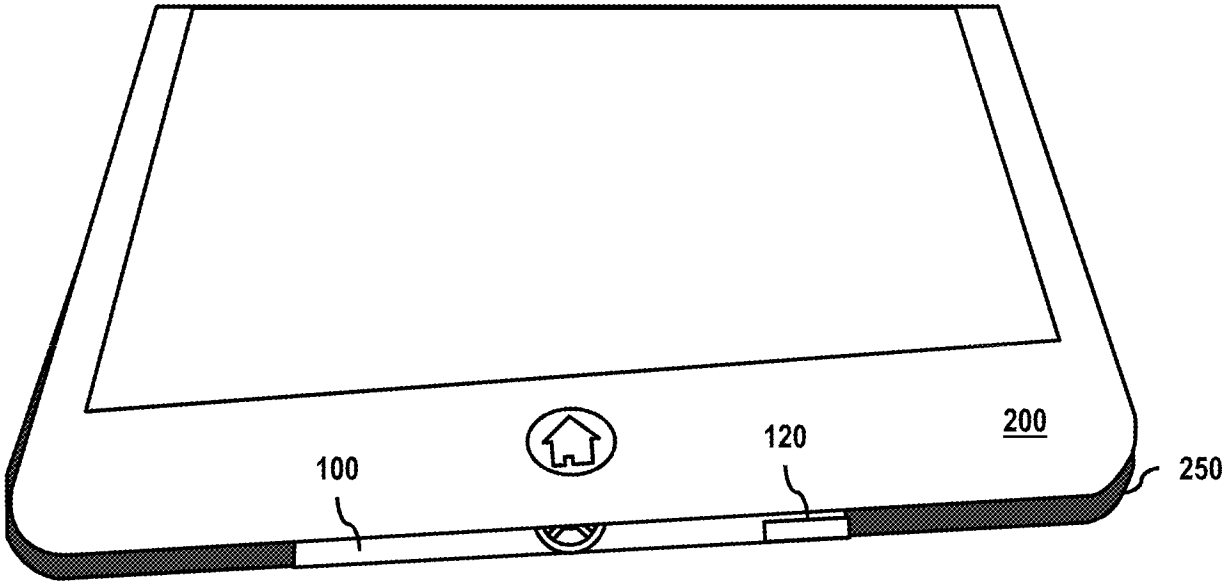
FIG. 2A is a diagram illustrating a portable device with a sound reflector in a retracted position, according to one embodiment.
Figure 2B:
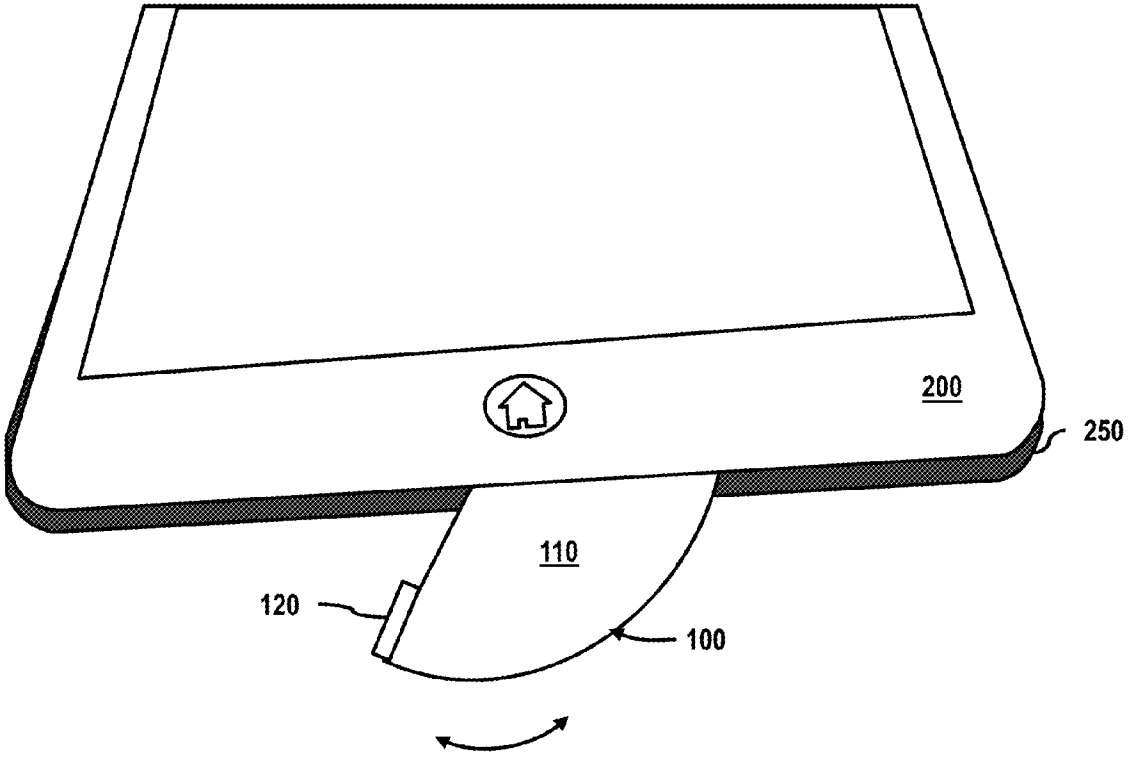
FIG. 2B is a diagram illustrating the sound reflector shown in FIG. 1A in a partially extended position, according to one embodiment.
Figure 2C:
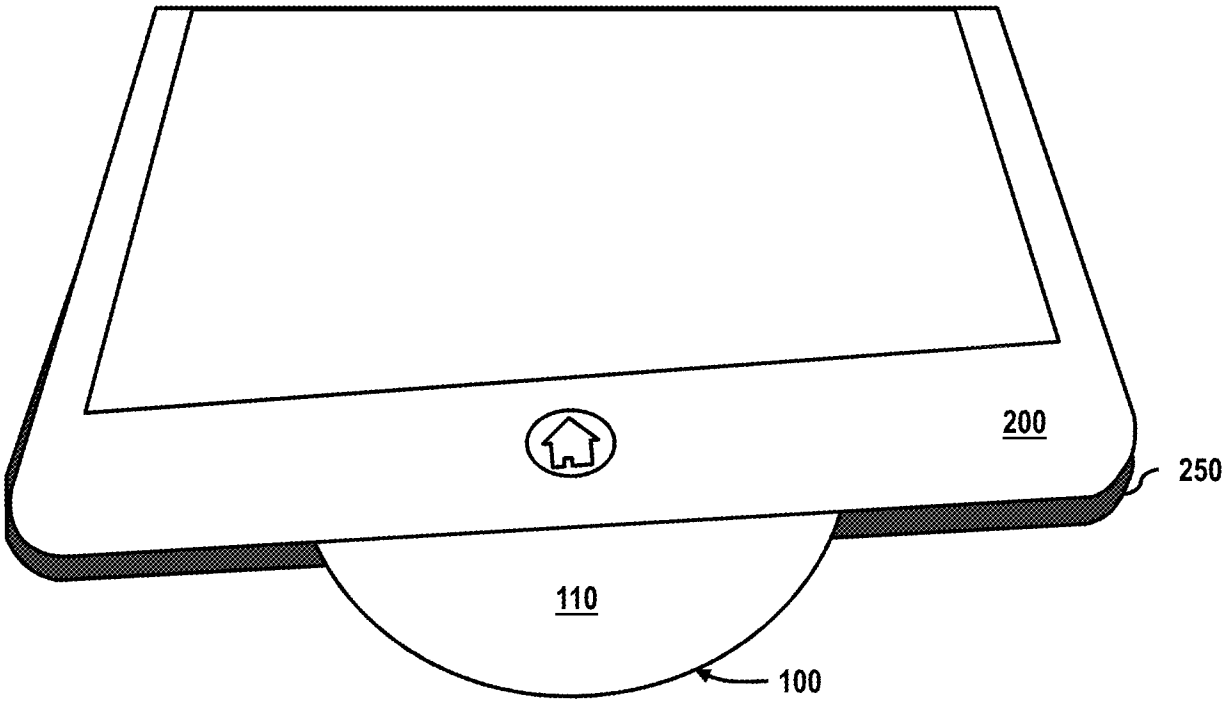
FIG. 2C is a diagram illustrating the sound reflector shown in FIG. 1A in a partially extended position, according to one embodiment.

FIGS. 2A-2C illustrate a sound reflector 100 in use with a portable device 200, in accordance with one embodiment. The portable device 200 can correspond to various types of devices including, but not limited to, tablets, PDAs, mobile phones, etc. Such portable devices 200 typically include one or more speakers (not shown) on a rear surface thereof for providing sound associated with the portable device 200. Additionally, such portable devices 200 are often used in conjunction with a case 250 (or enclosure) that is intended to provide various benefits. For example, such cases can incorporate various designs and/or images which a user desires. Additionally, such cases can be constructed of different materials to provide impact and/or shock absorbing properties. The cases can further incorporate batteries capable of supplementing the internal power of the portable device 200.

As illustrated in FIG. 2A, the sound reflector 100 is positioned between the portable device 200 and the case 250. Although a portion of the sound reflector 100 is visible, it can be generally accessed using the engaging tab. Furthermore, the protrusions 140 on the connector 130 (See FIG. 1C) cause a predetermined amount of separation between the portable device 200 and the case 250, thereby allowing rotation and/or movement of the sound reflector 100. According to the illustrated embodiment, the portable device 200 includes a single speaker which is centrally located near the lower edge. When a user operates the portable device 200, for example to watch a movie, the sound reflector 100 is rotated using the engaging tab in order to expose the portion inserted between the portable device 200 and the case 250. As shown in FIG. 2B, the sound reflector 100 is rotated about an axis defined by the protrusions until it is fully exposed (or extended).

FIG. 2C illustrates the position of the sound reflector 100 after it has been rotated to the fully extended position. When a user desires to watch a movie or video, for example, the portable device 200 can be placed on any surface and the sound reflector 100 will redirect sound emitted from the speaker toward the front of the portable device 200. In particular, the effective amount of sound reflected toward the user can be improved even further when the portable device 200 is held in an upright manner. More particularly, when the portable device 200 is held in an upright manner, the speaker generally directs sound away from the user. Although some sound can still reach the user a substantial amount is directed in the opposite direction, thereby limiting the overall experience. By incorporating a sound reflector 100, the user is capable of redirecting the output of the speaker in such a manner that the overall audible output can be improved.

Figure 3A:
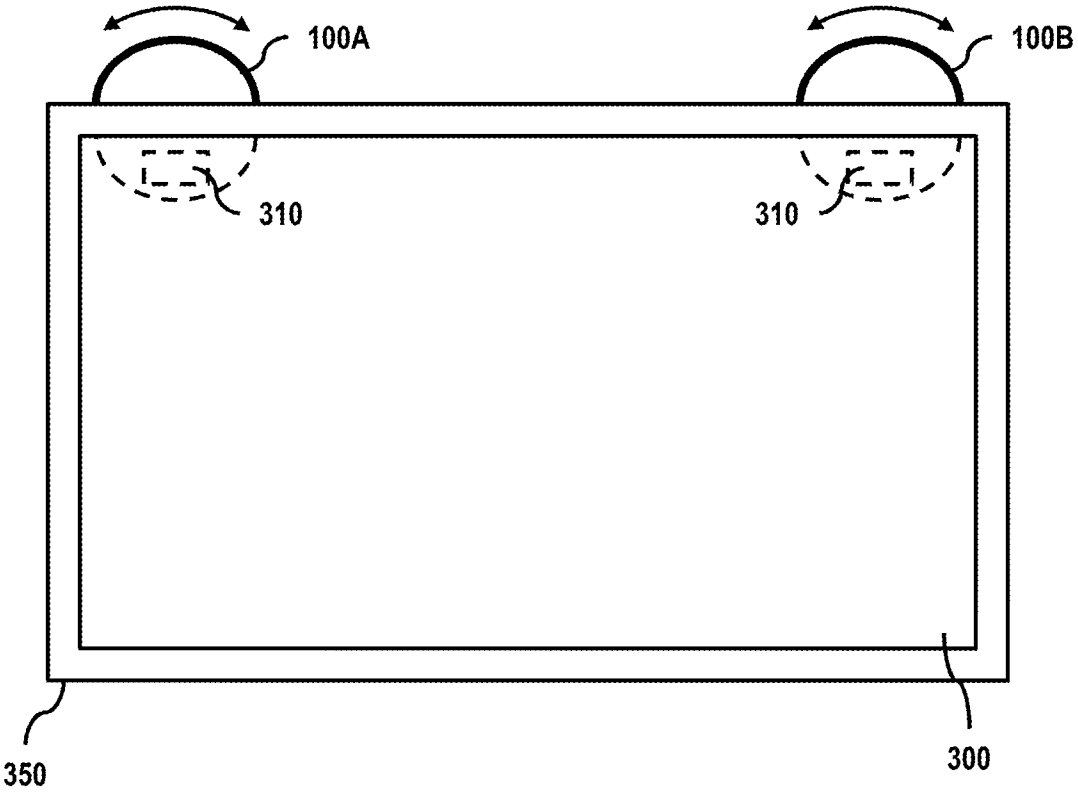
FIG. 3A is a diagram illustrating a portable device with multiple sound reflectors, according to one embodiment.

FIG. 3A illustrates the use of a sound reflector (100A, 100B) with a portable device 300 in accordance with another embodiment. As illustrated in FIG. 3A, the portable device 300 is disposed within a case 350. The portable device 300 also includes two speakers 310 that are located at the upper left and right edges of the portable device 300. Similar to the portable device 200 shown in FIGS. 2A-2C, the speakers 310 are positioned on the rear surface of the portable device 300. According to the illustrated embodiment, two sound reflectors (100A, 100B) are incorporated for interaction with each respective speaker. Thus, both sound reflectors would be rotated to the extended position in order to redirect the audio output of each speaker.

Figure 3B:
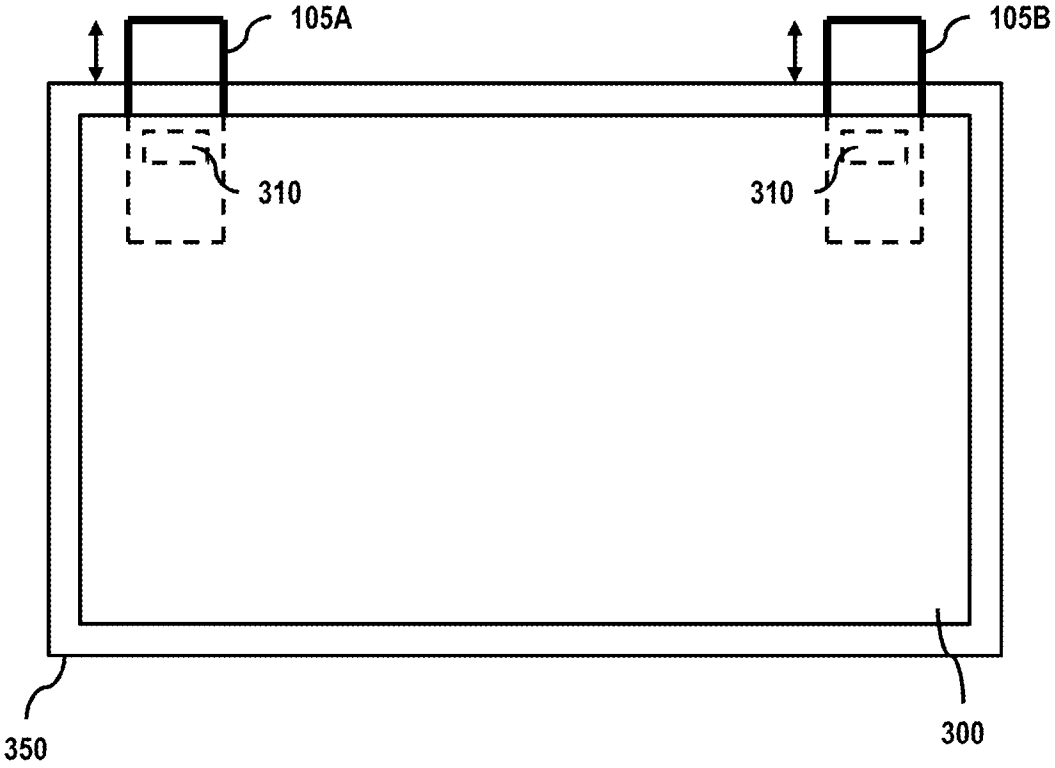
FIG. 3B is a diagram illustrating a portable device with multiple sound reflectors, according to another embodiment.

FIG. 3B illustrates the use of sound reflectors (105A, 105B) with a portable device 300 in accordance with another embodiment. The sound reflectors (105A, 105B) shown in FIG. 3B the incorporate a rectangular configuration. Thus, rather than rotating the sound reflectors (105A, 105B), the engaging tab would be used to pull in the direction illustrated by the arrows. Thus, each sound reflector (105A, 105B) would be pulled in order to occupy the extended position, and pushed back in order to occupy the retracted position.

Figure 4A:
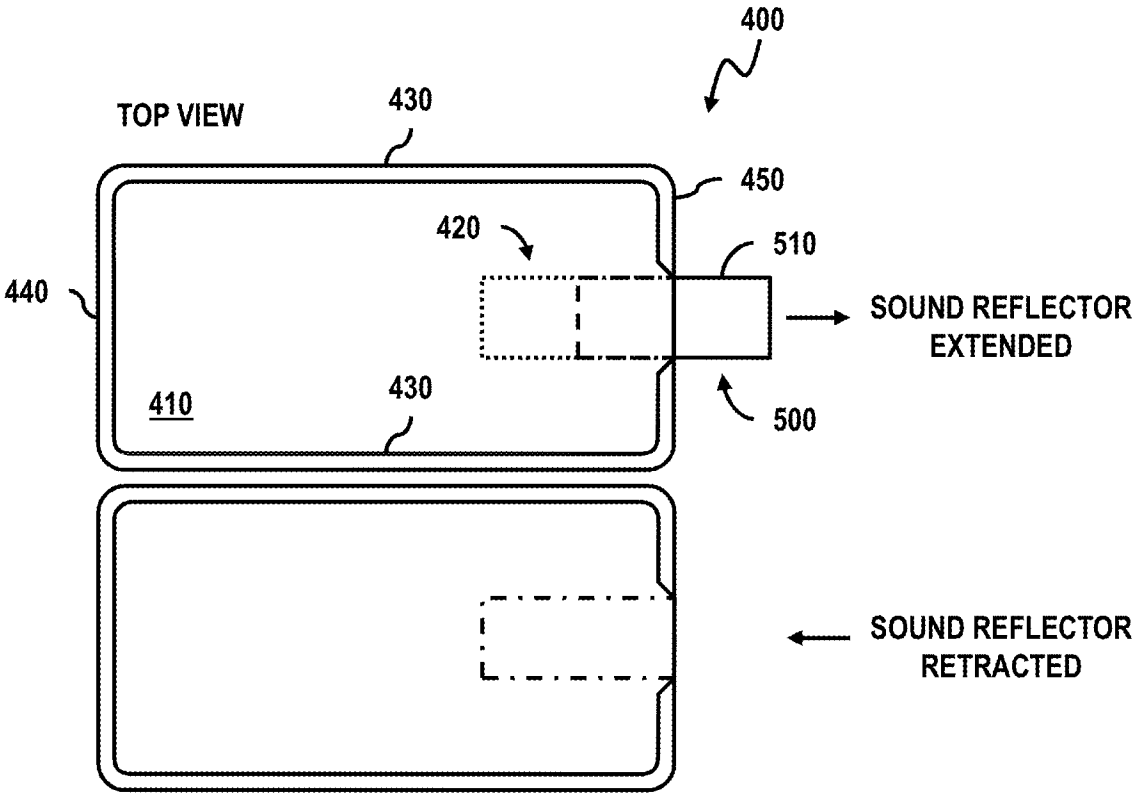
FIG. 4A is a top elevation view of a portable device enclosure, according to one embodiment.
Figure 4B:
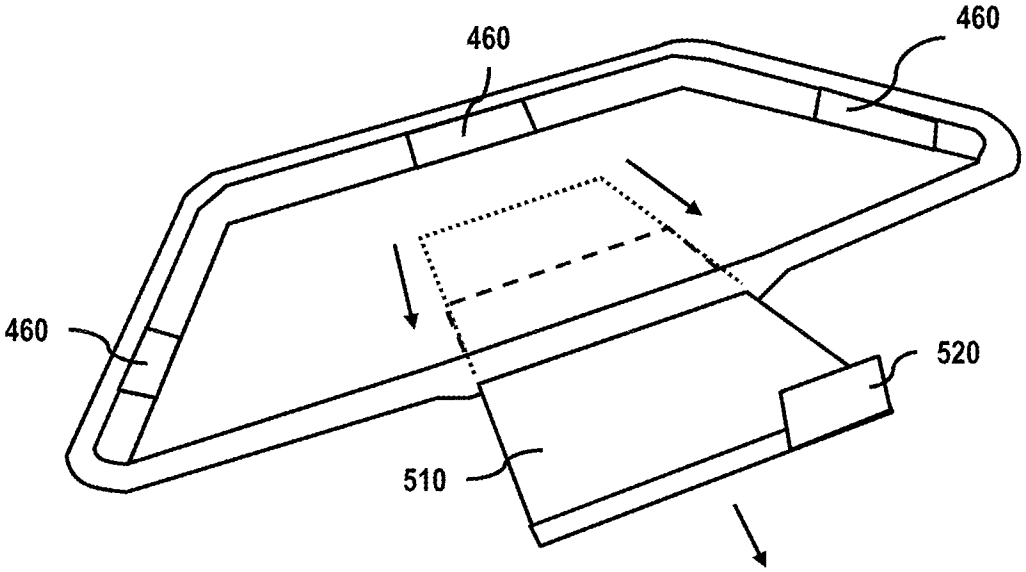
FIG. 4B is a perspective view of the portable device enclosure shown in FIG. 4A, according to one embodiment.

FIGS. 4A and 4B illustrate a case 400 for a portable device 200 which incorporates a sound reflector 500 in accordance with one embodiment. As can be appreciated, portable devices come in different sizes and configurations, thereby requiring the case 400 to be configured for specific types of devices. For example, tablets are available with different screen sizes ranging from 7 to 10 inches. Furthermore, the screen aspect ratios can vary from tablet to tablet. Similarly, mobile phones come in different sizes and shapes based on specific manufacturer configurations. Accordingly, the case 400 can be specifically constructed to accommodate any and all such portable devices.

As illustrated in FIG. 4A, the case 400 includes a base 410 which has an opening 420 corresponding to the location of the speaker (or speakers) of the portable device 200. The case 400 also includes two side portions 430, a top portion 440, and a bottom portion 450 which all extend from the base 410 in a substantially perpendicular manner. The side portions 430, top portion 440, and bottom portion 450 are also configured to extend at least up to the surface of the portable device 200 such that the portable device 200 can be securely retained within the case 400. According to at least one embodiment, the side portions 430, top portion 440, and bottom portion 450 can extend a predetermined distance beyond the surface of the portable device 200 in order to protect the portable device 200 in case it falls or an item is dropped on its surface. The case 400 further includes a sound reflector 500 having a generally rectangular configuration located near the bottom edge thereof. Depending on the specific configuration, the bottom portion 450 can include an opening to allow extension and retraction of the sound reflector 500. According to other embodiments, the bottom portion 450 can simply include a cutout through which the sound reflector 500 can pass.

As illustrated in FIG. 4B, the case 400 can include a plurality of access ports 460 provided on the side portions 430, top portion 440, and bottom portion 450. The access ports 460 are located in positions which correspond to the actual location of ports and/or buttons of the portable device 200. For example, such ports can include a charging port, a headphone port, a flash memory ports, etc. Additionally, the buttons can be in the form of a power button, volume, etc. Thus, a user can have full access to features of the portable device 200 while using the case 400. As further illustrated in FIG. 4B, the sound reflector 500 also includes an engaging tab 520 which can be used to affect movement between the extended and retracted positions. It should be noted that the case 400 is not limited to incorporation of a single sound reflector 500. Rather, the case 400 can be configured to incorporate multiple sound reflectors depending on the number of speakers included in the portable device 200, as well as different speaker locations.

Certain portable devices further incorporate speakers on a bottom surface rather than the rear surface. The bottom surface corresponds to the surface which abuts the bottom portion 450 of the case 400. Certain portable devices can also incorporate an amount of curvature toward the edges which can cause the speakers to be angled slightly in a direction facing the bottom surface. FIG. 4C illustrates a sound reflector 600A that can be used with such portable devices, in accordance with at least one embodiment. The sound reflector 600A includes a shield 610A having a substantially rectangular shape. Additionally, a lip 620A extends from the shield 610A at a predetermined angle. Such a sound reflector 600A can be used in conjunction with portable devices having speakers along the bottom surface in order to reflect the sound toward the user facing the portable device. According to the illustrated embodiment, the lip 620A can optionally function as an engaging tab for extending the sound reflector 600A. Alternatively, a separate engaging tab (not shown) can be attached to the lip 620A.

Figure 4D:
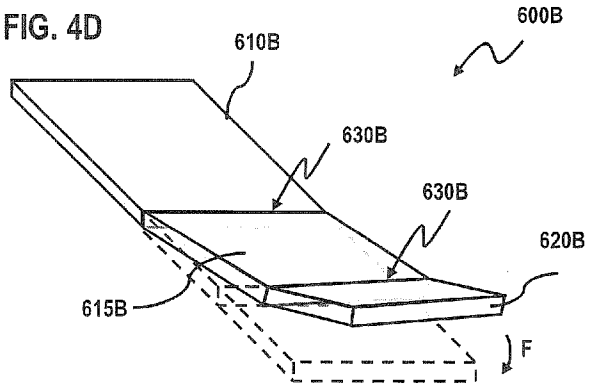
FIG. 4D illustrates a sound reflector for the portable device enclosure shown in FIG. 4A, according to one embodiment.
Figure 4C:
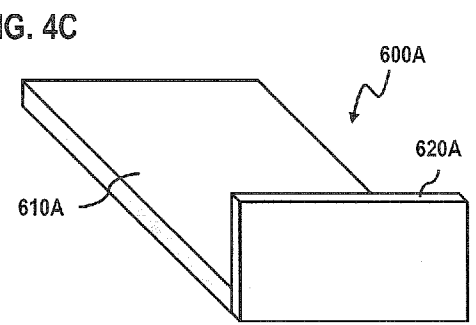
FIG. 4C illustrates a sound reflector for the portable device enclosure shown in FIG. 4A, according to one embodiment.

FIG. 4D illustrates a sound reflector 600B in accordance with at least one embodiment. The sound reflector 600B includes a shield 610B, an intermediate portion 615B and a lip 620B. A fold 630B is provided between the shield 610B and the intermediate portion 615B, and between the intermediate portion 615B and the lip 620B. The folds 630B allow portions of the sound reflector 600B to be bent at different angles relative to each other. For example, the lip 620B can be bent relative to the intermediate portion 615B. Similarly, the intermediate portion 615B can be bent relative to the shield 610B. As can be appreciated, movement of the intermediate portion 615B also results in a relative displacement of the lip 620B due to its connection with the intermediate portion 615B.

According to at least one embodiment, the folds 630B can incorporate a predetermined spring tension which causes the intermediate portion 615B and/or the lip 620B to bend at a predetermined angle. Thus, when the sound reflector 600B is in a free state (corresponding to the extended position), the intermediate portion 615B and the lip 620B would naturally bend at the predetermined angle in order to reflect sound toward the front of the portable device. In order to place the sound reflector 600B is placed in the retracted position, a force (F) is applied to counter the spring tension and straighten the sound reflector 600B, thereby enabling insertion into the case. According to other embodiments, the folds 630B can be constructed from materials having memory retaining properties such that the intermediate portion 615B and lip 620B can be bent at a desired angle to accommodate different users and/or devices. The intermediate portion 615B and lip 620B can subsequently be straightened in order to place the sound reflector 600B in the retracted position. Although not shown in the figure, an engaging similar to the engaging tab 520 shown in FIG. 4B can be provided at an end of the lip 620B in order to assist in extending the sound reflector 600B.

Figure 4E:
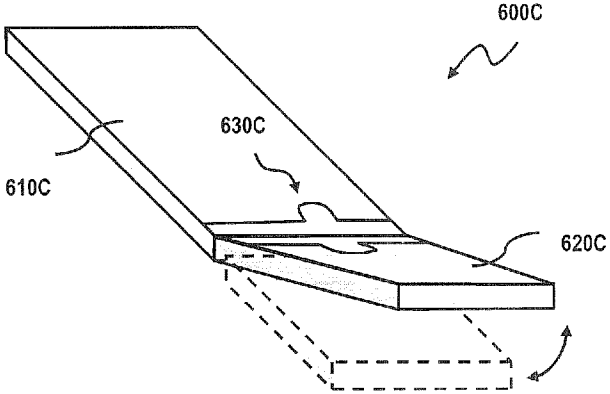
FIG. 4E illustrates a sound reflector for the portable device enclosure shown in FIG. 4A, according to one embodiment.

FIG. 4E illustrates a sound reflector 600C according to another embodiment. The sound reflector 600C includes a shield 610C and a lip 620C. A hinge 630C, or other pivoting mechanism, is provided for connecting the shield 610C and lip 620C. The hinge 630C allows the lip 620C to be moved along an arc, as indicated by the directional arrow. Thus, the lip 620C can be positioned at any desired angle to direct sound toward the front of the portable device. According to at least one embodiment, the hinge 630C can incorporate a predetermined tension for preventing unassisted movement of the lip 620C relative to the shield 610C. Thus, the lip 620C could be manually adjusted to a desired angle and remain in such position until, for example, changed to retract the sound reflector 600C. Alternatively, a simple locking mechanism (e.g., threaded fastener based) can be incorporated for locking the lip 620C at a predetermined angle. Although not shown in the figure, an engaging similar to the engaging tab 520 shown in FIG. 4B can be provided at an end of the lip 620C in order to assist in extending the sound reflector 600C.

Figure 5A:
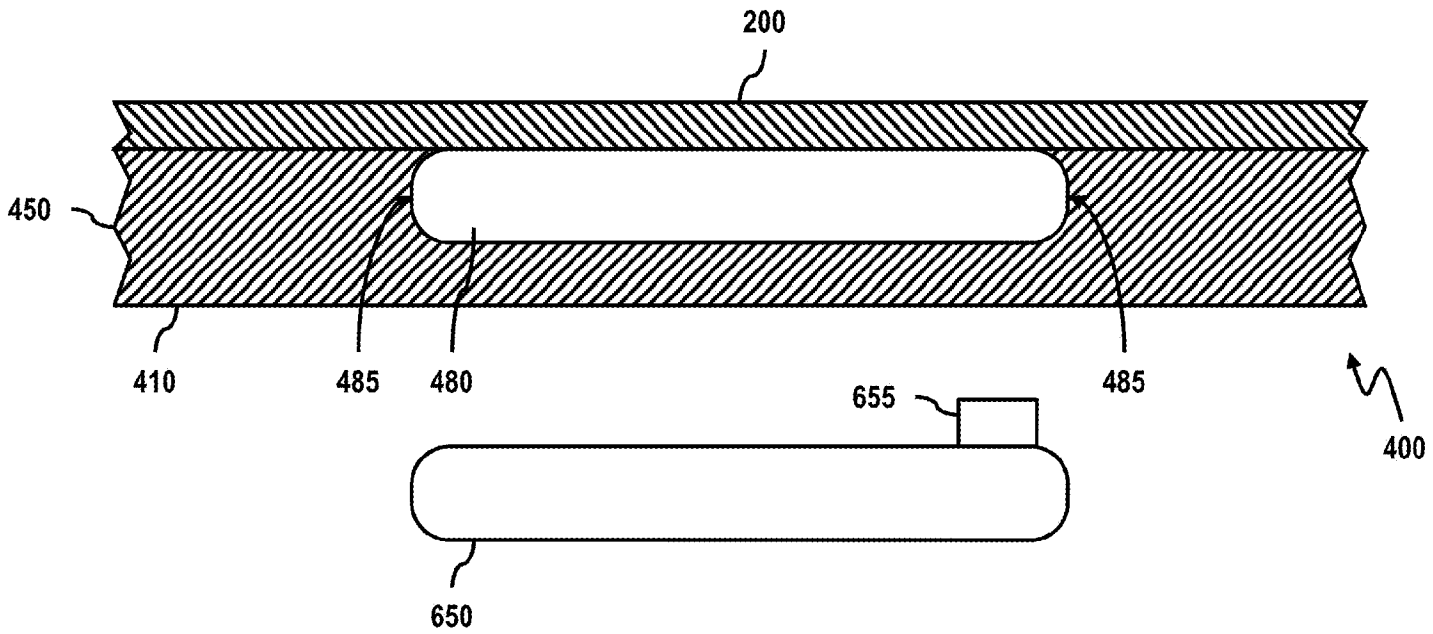
FIG. 5A is sectional view of a portable device enclosure illustrating a configuration for receiving a sound reflector, according to one embodiment.

FIG. 5A is a partial sectional view which illustrates a configuration for the case 400 and sound reflector 650 in accordance with one embodiment. The illustrated case 400 includes a bottom portion 450 which has a recessed portion 480, or cutout, that extends into the base 410. The recessed portion 480 is sized to accommodate the width of the sound reflector 650. Furthermore, the bottom portion 450 includes a groove 485, or channel, configured to accommodate the sound reflector 650. The sound reflector 650 is also configured to have a taper, or corresponding shape, which matches the recessed portion 480 and groove 485. Optionally and/or additionally, the base 410 can include a recessed portion which receives the sound reflector 650. The recessed portion can also include a corresponding groove, thereby allowing the sound reflector 650 to be extended and retracted along a predetermined path. Nonetheless, once the portable device 200 is inserted into the case 400, it functions together with the case 400 to form a top surface of an enclosure for the sound reflector 650. An engaging tab 655 is also provided in order to extend and retract the sound reflector 650.

Figure 5B:
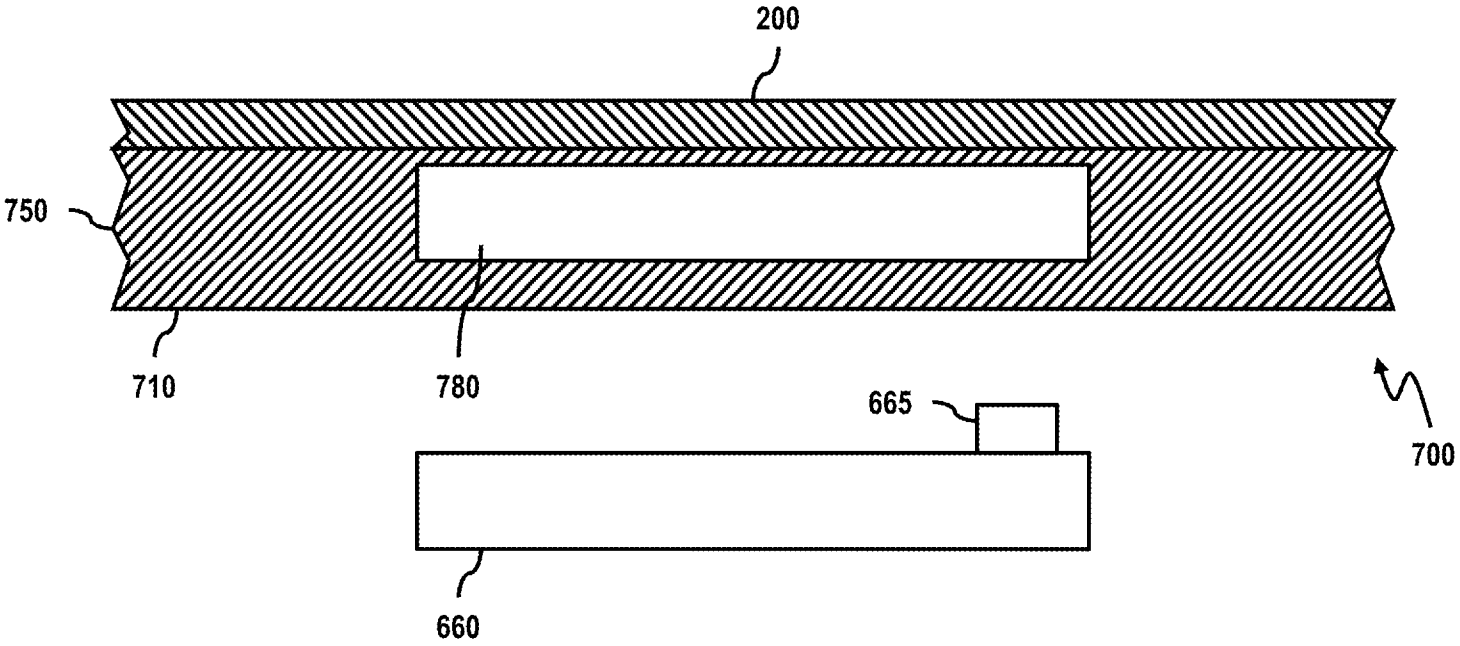
FIG. 5B is sectional view of a portable device enclosure illustrating a configuration for receiving a sound reflector, according to one embodiment.

FIG. 5B illustrates a configuration for the case 700 and sound reflector 660 in accordance with at least one embodiment. According to the illustrated embodiment, the base 710 and bottom portion 750 define a compartment 780 within which the sound reflector 660 is positioned. Thus, the sound reflector 660 can be securely retained within the case 700. Furthermore, it is not necessary to utilize the portable device 200 to form part of the compartment 780. The sound reflector 660 can also include an engaging tab to facilitate extension and retraction.

While certain exemplary embodiments and implementations have been described herein, other embodiments and modifications will be apparent from this description. Accordingly, the various embodiments described are not intended to be limiting, but rather are encompassed by the broader scope of the presented claims and various obvious modifications and equivalent arrangements.

What is claimed is:

1. An apparatus comprising:

a shield having a substantially semicircle shape with a straight edge, a curved edge, and a flat semicircle main surface between the straight edge and the curved edge, the flat semicircle main surface being configured for reflecting sound;

an engaging tab extending from the shield;

a connector attached to the flat semicircle main surface of the shield and located approximately a midpoint of the straight edge; and at least one protrusion extending perpendicularly from the connector, wherein the shield and connector are positionable between a bottom surface of a portable device and a case, and wherein the shield is movable between a retracted position and an extended position which covers at least a portion of a speaker of the portable device and reflects sound emitted therefrom.

2. An apparatus of claim 1, wherein:

the shield has a semicircular shape of 270° or less, and the shield is movable between the retracted and extended positions by rotation about an axis defined by the at least one protrusion.

3. An apparatus comprising:

a shield having a substantially semicircle shape with a straight edge, a curved edge, and a flat semicircle main surface between the straight edge and the curved edge, the flat semicircle main surface being configured for reflecting sound;

an engaging tab extending from the shield;

a connector attached to a periphery of the shield and located approximately a midpoint of the straight edge; and at least one protrusion extending perpendicularly from the connector, wherein the shield and connector are positionable between a bottom surface of a portable device and a case, and wherein the shield is movable between a retracted position and an extended position which covers at least a portion of a speaker of the portable device and reflects sound emitted therefrom, and wherein the shield is movable between the retracted and extended positions by pivoting about an axis defined by the at least one protrusion.

4. An apparatus comprising:

an enclosure for receiving a portable device therein, the enclosure including:

a base having one or more openings corresponding to one or more speaker locations of the portable device, two side portions, a top portion, and a bottom portion, all extending from the base to a height equal to or greater than a height of the portable device when positioned in the enclosure, and a plurality of access ports corresponding interface ports and/or control points of the portable device; and at least one sound reflector disposed within the enclosure in proximity to the at least one openings, the sound reflector having a substantially flat surface and being configured for reflecting sound, wherein the at least one sound reflector is movable between a retracted position and an extended position, and wherein the at least one sound reflector overlaps at least a portion of the one or more openings.

5. An apparatus of claim 4, further comprising at least one compartment formed within the base of the enclosure for accommodating the at least one sound reflectors in the retracted position.

6. An apparatus of claim 4, wherein the enclosure further comprises:

at least one recessed portion formed on the base, and grooves formed on sidewalls of the at least one recessed portion, wherein the at least one sound reflectors are configured for extension and retraction along the grooves.

7. An apparatus of claim 4, further comprising an engaging tab extending from the at least one sound reflector.

8. An apparatus of claim 4, further comprising a lip portion extending from the at least one sound reflector in a direction away from the base.

9. An apparatus of claim 4, wherein each of the at least one sound reflector, comprises:

a shield having a substantially flat surface;

a lip portion; and a fold integrally connecting the lip portion to the shield.

10. An apparatus of claim 9, further comprising:

an intermediate portion disposed between the shield and the lip portion; and a second fold integrally connecting the intermediate portion to the shield, wherein the fold integrally connects the lip and the intermediate portion.

11. An apparatus of claim 9, wherein the fold is constructed from a memory retaining material capable of maintaining a selected angle.

12. An apparatus of claim 9, wherein the fold incorporates a predetermined spring tension for bending the lip portion at a predetermined angle relative to the shield.

13. An apparatus of claim 4, wherein each of the at least one sound reflector, comprises:

a shield having a substantially flat surface;

a lip portion; and a hinge for pivotally connecting the lip portion to the shield.

14. An apparatus of claim 13, further comprising a locking mechanism for securing the hinge at a selected angle.

* * * * *